US007963642B2

(12) United States Patent
Umeda

(10) Patent No.: US 7,963,642 B2
(45) Date of Patent: Jun. 21, 2011

(54) INK-JET PRINTER

(75) Inventor: Takaichiro Umeda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 590 days.

(21) Appl. No.: 12/128,091

(22) Filed: May 28, 2008

(65) Prior Publication Data

US 2008/0297569 A1 Dec. 4, 2008

(30) Foreign Application Priority Data

May 28, 2007 (JP) ..... 2007-140536

(51) Int. Cl.
*B41J 2/175* (2006.01)

(52) U.S. Cl. ..... 347/85; 347/65; 347/66; 347/84; 347/86; 347/87; 347/88; 347/89; 347/90; 347/91; 347/92; 347/93; 347/94

(58) Field of Classification Search ..... 347/65–66, 347/84–94
See application file for complete search history.

(56) References Cited

U.S. PATENT DOCUMENTS 4,383,263 A * 5/1983 Ozawa et al. ..... 347/30
5,113,205 A * 5/1992 Sato et al. ..... 347/85
6,264,318 B1 * 7/2001 Oda et al. ..... 347/86
6,969,161 B2 * 11/2005 Kuwabara et al. ..... 347/85
6,971,741 B2 * 12/2005 Nanjo et al. ..... 347/85
7,077,513 B2 * 7/2006 Kimura et al. ..... 347/85
7,097,288 B2 * 8/2006 Van Os et al. ..... 347/85
7,338,153 B2 * 3/2008 Van Os et al. ..... 347/85
7,607,770 B2 * 10/2009 Inoue et al. ..... 347/85

FOREIGN PATENT DOCUMENTS

JP 2000-296621 A 10/2000
JP 2004-174944 A 6/2004
JP 2004-358918 A 12/2004

* cited by examiner

*Primary Examiner* — Ryan Lepisto
*Assistant Examiner* — Guy G Anderson
(74) *Attorney, Agent, or Firm* — Baker Botts L.L.P.

(57) ABSTRACT

An ink-jet printer, including: a recording head which ejects ink onto a recording medium; a main tank which stores the ink to be supplied to the recording head; a sub tank configured to be extended and contracted in a vertical direction and including first and second ink flow holes provided in a lower portion of the sub tank, such that the first ink flow hole communicates with the recording head while the second ink flow hole communicates with the main tank; and a communication tube which is connected, at one of opposite ends thereof, to the second ink flow hole and which has, at the other of opposite ends thereof, an opening positioned in an inside space of the sub tank, whereby the second ink flow hole and the inside space of the sub tank communicate with each other via the communication tube, wherein the communication tube is configured such that the opening of the communication tube is displaced downwardly in accordance with the contraction of the sub tank.

14 Claims, 6 Drawing Sheets

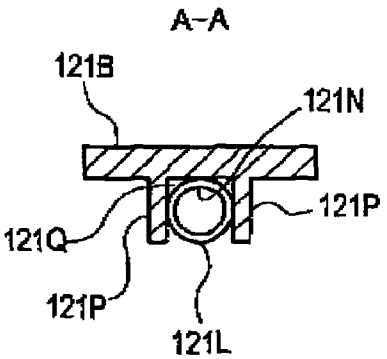
FIG.3B
FIG.3A
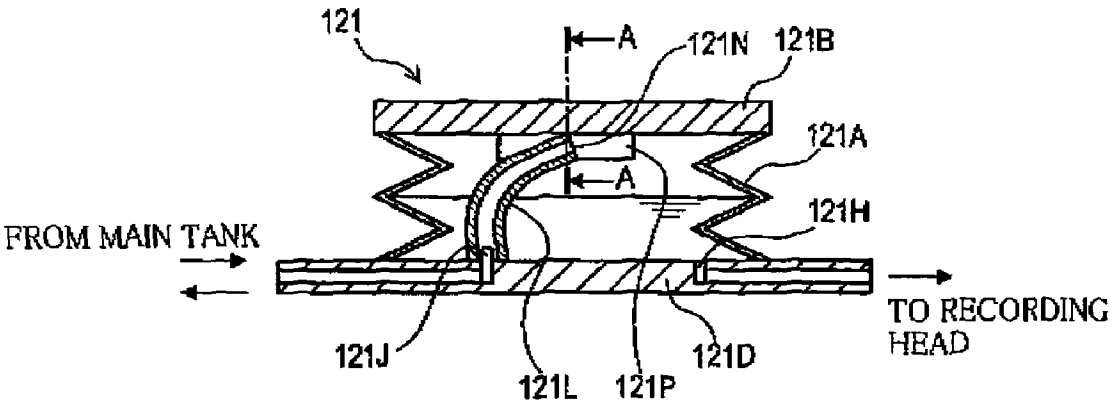
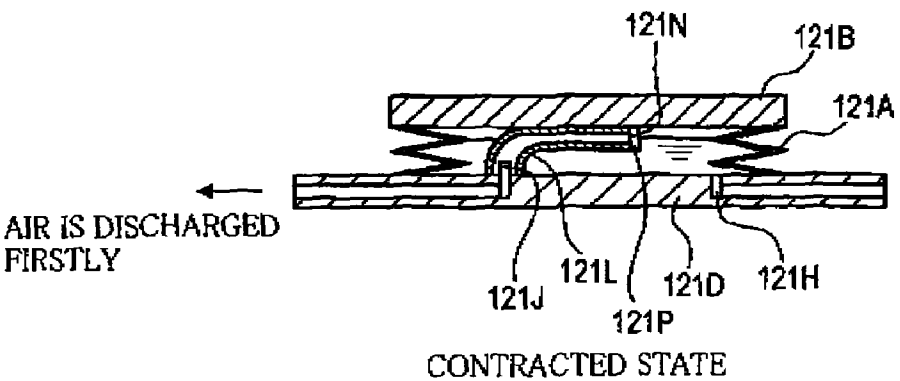
FIG.3C

INK-JET PRINTER

CROSS REFERENCE TO RELATED APPLICATION

The present application claims priority from Japanese Patent Application No. 2007-140536, which was filed on May 28, 2007, the disclosure of which is herein incorporated by reference in its entirety.

BACKGROUND OF THE INVENTION

1. Field of the Invention

The present invention relates to an ink-jet printer including sub tanks which can be extended and contracted.

2. Description of the Related Art

Patent Document 1 (Japanese Patent Application Publication No. 2004-358918) discloses an ink-jet printer including extendable and contractable sub tanks provided in a path leading ink from a main tank to a recording head. The ink is temporarily accommodated in the sub tanks, thereby evening an ink pressure which is variable according to a remaining amount of the ink in the main tank.

SUMMARY OF THE INVENTION

However, in the ink-jet printer disclosed in the Patent Document 1, first ink flow holes communicating with the recording head are respectively provided in upper portions of the respective sub tanks, and second ink flow holes communicating with the main tank are respectively provided in lower portions of the respective sub tanks. Thus, where the sub tanks are contracted in order to discharge air in the sub tanks to the main tank, air accumulated in upper end portions of inside spaces of the respective sub tanks is supplied to the recording head, and only the ink existing in lower portions of inside spaces of the respective sub tanks is supplied to the main tank. Thus, ink ejection failure easily occurs in comparison with an ink-jet printer not having a configuration like this.

This invention has been developed in view of the above-described situation, and it is an object of the present invention to provide an ink-jet printer in which air in the sub tanks can be reliably discharged to the main tank.

The object indicated above may be achieved according to the present invention which provides an ink-jet printer comprising: a recording head which ejects ink onto a recording medium; a main tank which stores the ink to be supplied to the recording head; a sub tank configured to be extended and contracted in a vertical direction and including first and second ink flow holes provided in a lower portion of the sub tank, such that the first ink flow hole communicates with the recording head while the second ink flow hole communicates with the main tank; and a communication tube which is connected, at one of opposite ends thereof, to the second ink flow hole and which has, at the other of opposite ends thereof, an opening positioned in an inside space of the sub tank, whereby the second ink flow hole and the inside space of the sub tank communicate with each other via the communication tube, wherein the communication tube is configured such that the opening of the communication tube is displaced downwardly in accordance with the contraction of the sub tank.

In the ink-jet printer constructed as described above, the second ink flow hole and the inside space of the sub tank communicate with each other via the opening which is displaced downwardly in accordance with the contraction of the sub tank. Further, air in the sub tank is always positioned in an upper portion of the inside space of the sub tank irrespective of a degree of a contraction of the sub tank.

Thus, the ink-jet printer according to the present invention can be configured such that the opening is positioned, irrespective of the degree of the deformation of the sub tank, at a part of the inside space of the sub tank in which air is accumulated. Where the ink-jet printer is thus configured, the air in the sub tank can be reliably discharged to the main tank.

BRIEF DESCRIPTION OF THE DRAWINGS

The objects, features, advantages, and technical and industrial significance of the present invention will be better understood by reading the following detailed description of preferred embodiments of the invention, when considered in connection with the accompanying drawings, in which:

FIGS. 3A and 3C are cross-sectional views of one of the sub tanks 121, and FIG. 3B is a cross-sectional view showing a cross section of FIG. 3A taken along a line A-A;

DESCRIPTION OF THE PREFERRED EMBODIMENTS

In the present embodiment, an, ink-jet printer according to the present invention is applied to an ink-jet printer of a station supply type. Hereinafter, there will be described, by reference to the drawings, the ink-jet printer of the station supply type as the present embodiment according to the present invention.

1. Summary of Ink-Jet Printer as the Present Embodiment

The ink-jet printer, as is well known, forms an image on a recording medium such as a recording sheet by ejecting fine ink droplets onto the sheet. When forming a color image, the ink-jet printer ejects ink of various colors different from each other, e.g., cyan, magenta, yellow, and black, such that the different-color inks are overlaid on one another.

Also, in the ink-jet printer of the station supply type, the main tank unit 130 and the sub tanks 121 that will be described below are connected to each other when the ink is supplied to the sub tanks 121, whereas the main tank unit 130 and the sub tanks 121 are not connected to each other when the ink is not supplied to the sub tanks 121, for example, when the image is being formed.

In this ink-jet printer, when a remaining amount of the ink in the sub tanks 121 is equal to or smaller than a certain amount, the main tank unit 130 and the sub tanks 121 are connected to each other to refill the sub tanks 121 with the ink. On the other hand, when the remaining amount of the ink in the sub tanks 121 is larger than the certain amount, the main tank unit 130 and the sub tanks 121 are not connected to each other.

2. Recording Head Unit

Figure 1:
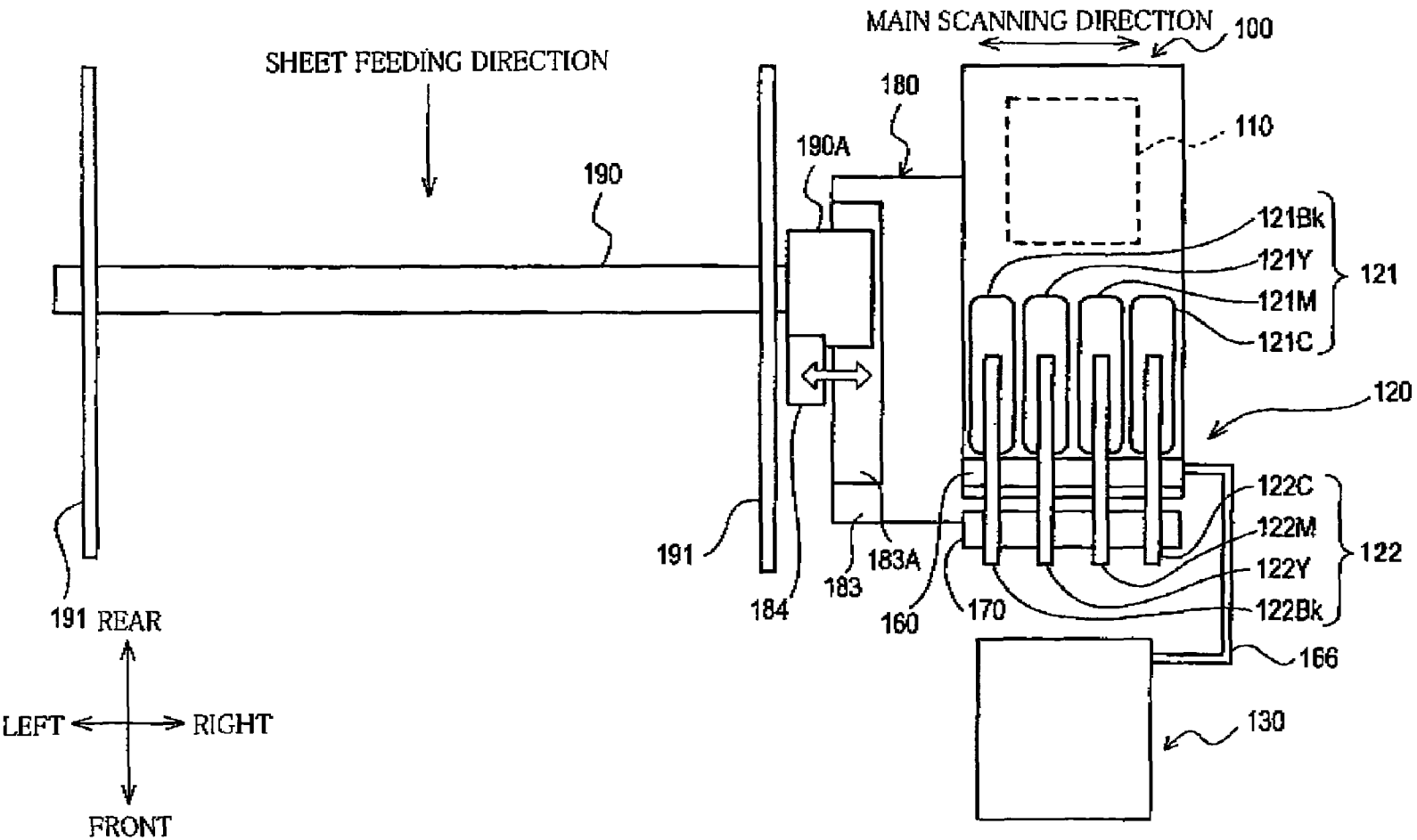
FIG. 1 is a schematic view of an image forming section of an ink-jet printer as the present embodiment as seen from an upper side of the ink-jet printer.

In FIG. 1, a recording head unit 100 includes a recording head 110 for ejecting the ink droplets onto the sheet, a sub tank unit 120 for supplying the ink to the recording head 110, and so on. The recording head 110, the sub tank unit 120, and so on are mounted on a carriage (not shown). When the image is being formed, this recording head unit 100 is reciprocated in a direction that is perpendicular to a sheet feeding direction in which the sheet is fed and that is a direction parallel to one of opposite surfaces of the sheet on which the image is to be recorded. That is, the recording head unit 100 is reciprocated in a lateral direction in FIG. 1 (i.e., a main scanning direction).

It is noted that a plurality of nozzles (not shown) through which the ink is ejected are formed for each of the colors in one of faces of the recording head 110 which faces a fed sheet. These nozzles are arranged in a row or rows for each color in a direction parallel to the sheet feeding direction.

The sub tank unit 120 includes a plurality of the sub tanks 121C, 121M, 121Y, 121Bk which are aligned in the main scanning direction, pressing levers 122C, 122M, 122Y, 122Bk respectively for pressing the sub tanks 121C, 121M, 121Y, 121Bk, and so on.

In this respect, cyan (C) ink, magenta (M) ink, yellow (Y) ink, and black (Bk) ink are respectively stored in the sub tanks 121C, 121M, 121Y, 121Bk.

It is noted that since respective constructions of the sub tanks 121C, 121M, 121Y, 121Bk are identical with each other except for the type of the ink stored therein, hereinafter these sub tanks will be collectively referred to as sub tanks 121. Similarly, since the pressing levers 122C, 122M, 122Y, 122Bk are identical with each other except for the sub tanks 121 to be pressed thereby, hereinafter these pressing levers will be collectively referred to as pressing levers 122.

Figure 4B:
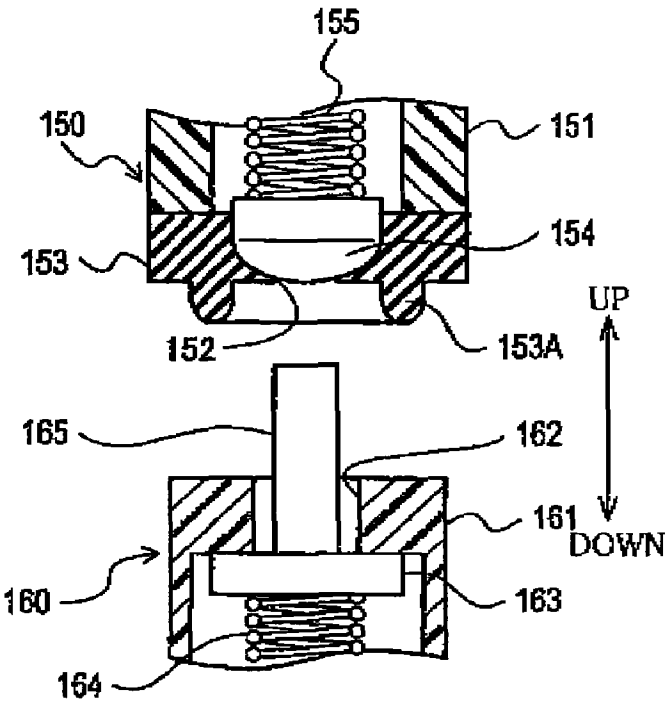
FIG. 4B is a view for explaining an operation of a joint valve upon the operation of supplying ink.
Figure 4A:
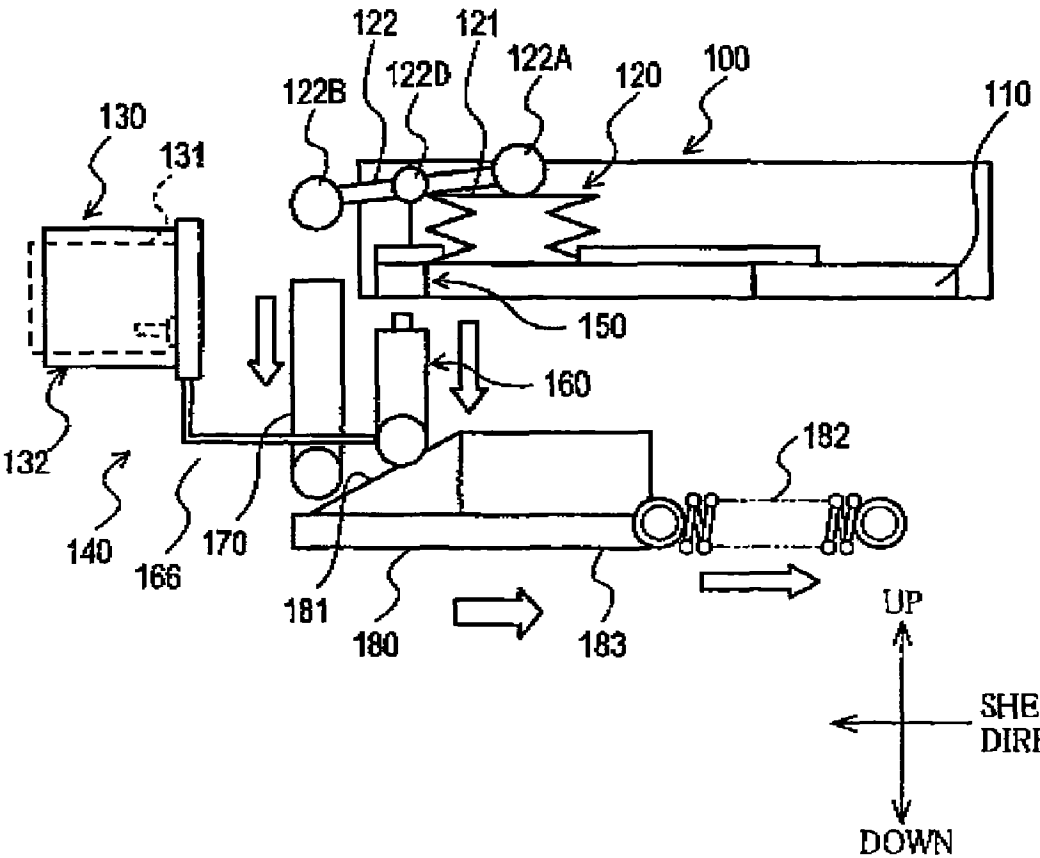
FIG. 4A is a view for explaining an operation of supplying ink.

Further, as shown in FIG. 4A, described for one of the pressing levers 122 for simplicity, the pressing lever 122 functioning as a pressing means is pivotably engaged at its one end 122A with an upper end portion of the sub tank 121. On the other hand, the other end 122B of the pressing lever 122 extends to an outside of an outer edge portion of the recording head unit 100. Between the one end 122A and the other end 122B in a longitudinal direction of the pressing lever 122, the pressing lever 122 is supported at a supported portion 122D thereof so as to be pivotable. It is noted that the supported portion 122D is provided on a main body of the recording head unit 100.

3. Sub Tanks

Described for one of the sub tanks 121 for simplicity, the sub tank 121 is configured to be deformed so as to be elastically extended and contracted in a direction perpendicular to the main scanning direction and the sheet feeding direction (hereinafter, the direction may be referred to as an extension and contraction direction). In this ink-jet printer, the sub tank 121 is deformed in a vertical direction. More specifically, as shown in, e.g., FIGS. 2B and 3A, the sub tank 121 includes a bellows portion 121A as a peripheral wall configured to be deformed so as to be extended and contracted in the vertical direction, a top plate portion 121B as an upper end wall which closes the bellows portion 121A from an upper side thereof, a bottom plate portion 121D as a lower end wall which closes the bellows portion 121A from a lower side thereof, and so on. In this respect, FIG. 2B shows a normal state of the sub tank 121 in which the sub tank 121 is extended, and FIG. 2C shows a state of the sub tank 121 in which the sub tank 121 is contracted.

It is noted that the extension and contraction direction of the sub tank 121 does not need to strictly coincide with a direction in which a vertical line extends, and may be displaced about 45 degrees with respect to the vertical line. As shown in FIG. 1, the sub tank 121 has a rectangular shape with its corners smoothly rounded in cross section in a plane perpendicular to the extension and contraction direction of the bellows portion 121A. It is noted that, in this ink-jet printer, longer sides of the sub tank 121 are parallel to the sheet feeding direction, and shorter sides thereof are parallel to the main scanning direction. Further, the plurality of the sub tanks 121 are aligned in the main scanning direction.

Further, the bellows portion 121A has a bellows shape and formed of a material with an excellent toughness such as a polypropylene (PP), a polyethylene (PE), or an elastomeric material. As shown in FIG. 2B, on an outer side of the bellows portion 121A, there is fitted a deformation restraining ring 121E as a deformation restraining member which restrains the sub tank 121 (i.e., the bellows portion 121A) from deforming in a direction intersecting the extension and contraction direction thereof (in this ink-jet printer, in the main scanning direction and a sub scanning direction).

Figure 2A:
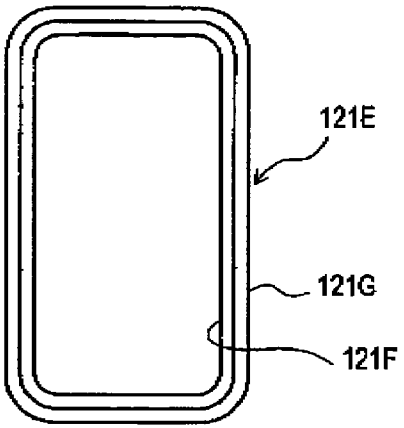
FIG. 2A is an elevational view of one of deformation restraining rings 121E.
Figure 2B:
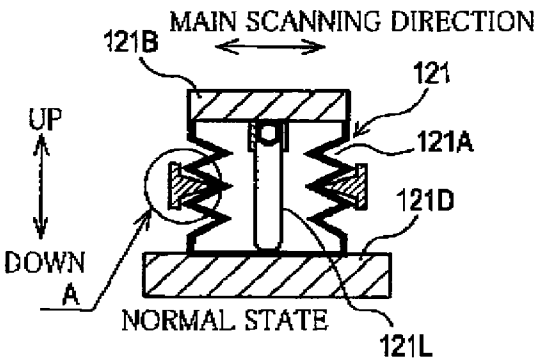
FIGS. 2B and 2C are views each showing a state in which one of the deformation restraining rings 121E is fitted on a corresponding one of sub tanks 121.
Figure 2C:
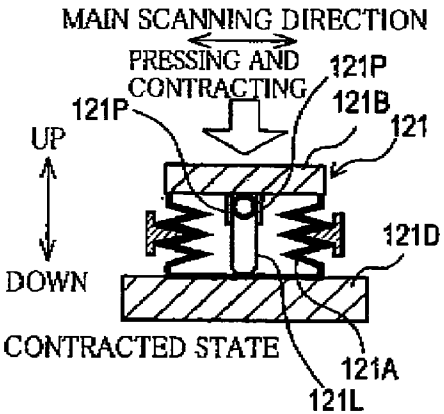

As shown in FIG. 2A, the deformation restraining ring 121E has a generally rectangular shape having rounded corners in cross-sectional shape of the bellows portion 121A. Further, as shown in FIG. 2D, this deformation restraining ring 121E includes a contacting portion 121F contacting the outer side of the bellows portion 121A, and a reinforcing portion 121G which reinforces the contacting portion 121F at a position opposed to the bellows portion 121A with the contacting portion 121F interposed therebetween.

It is noted that, in this ink-jet printer, the contacting portion 121F and the reinforcing portion 121G are each formed of a resin material having an excellent mechanical strength such as a polyacetal and are integral with each other. Further, as shown in FIG. 2B, in a state in which the contacting portion 121F is fitted on one of smaller diameter parts of the bellows portion 121A, the deformation restraining ring 121E is fitted on the outer side of the bellows portion 121A at a position at which to divide the bellows portion 121A into equal parts (in this ink-jet printer, two parts) in the extension and contraction direction of the bellows portion 121A.

Here, the position at which to divide the bellows portion 121A into equal parts in the extension and contraction direction is not limited to a position at which to strictly divide the bellows portion 121A into equal parts. Depending on a number of the smaller diameter parts and a size of each of the smaller diameter parts, the position at which to divide the bellows portion 121A into equal parts may be out of the position in which to strictly divide the bellows portion 121A into equal parts. That is, the position in which to divide the bellows portion 121A into equal parts in the extension and contraction direction means a position which can be visually recognized, by persons skilled in the art not using any measuring instrument such as a vernier caliper, to be a position in which to divide the bellows portion 121A into equal parts in the extension and contraction direction.

Figure 2D:
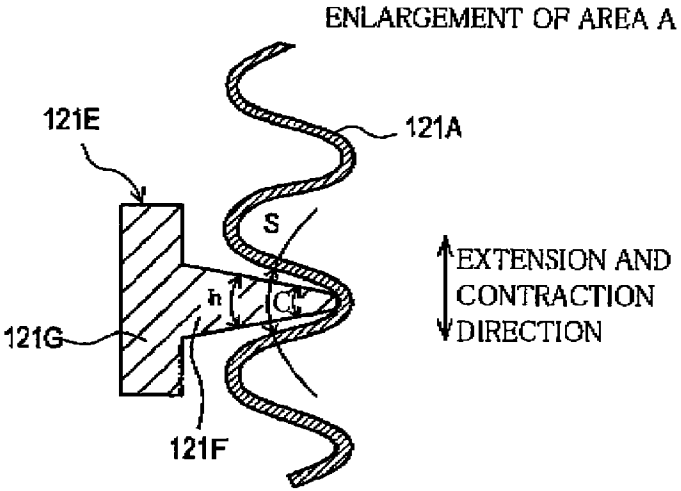
FIG. 2D is an enlarged view of an area A in FIG. 2B.

As shown in FIG. 2D, the contacting portion 121F has a taper shape (i.e., a triangle shape). That is, a dimension h of the contacting portion 121F in a direction parallel to the extension and contraction direction decreases as being nearer to the bellows portion 121A. An angle C of the contacting portion 121F is set to be equal to or smaller than an angle S of each smaller diameter part in a state in which the bellows portion 121A is contracted to the greatest extent.

Each of the top plate portion 121B and the bottom plate portion 121D has a material or a shape in which each of the top plate portion 121B and the bottom plate portion 121D has a flexural rigidity higher than that of the bellows portion 121A such that the top plate portion 121B and the bottom plate portion 121D are not to be bent or deformed when the top plate portion 121B is pressed by the pressing lever 122.

As shown in FIG. 3A, in the bottom plate portion 121D, there are formed a first ink flow hole 121H which communicates with the recording head 110, and a second ink flow hole 121J which communicates with the main tank unit 130. This second ink flow hole 121J and an upper end portion of an inside space of the sub tank 121 (i.e., a space near the top plate portion 121B) communicate with each other via a communication tube 121L. The entirety of the communication tube 121L is in the sub tank 121.

More specifically, the communication tube 121L is connected, at one of opposite ends thereof, to the second ink flow hole 121J from the inside space of the sub tank 121, and has, at the other of the opposite ends thereof an opening 121N that is open at the upper end portion of the inside space of the sub tank 121. That is, the communication tube 121L extends from the bottom plate portion 121D toward the top plate portion 121B. Also, in a state in which the sub tank 121 is extended, the opposite ends of the communication tube 121L are positioned at respective positions each of which is located outside a central part of the top plate portion 121B as seen from the upper side of the sub tank. It is noted that, in FIG. 3, the deformation restraining ring 121E is omitted due to limitations of space. Also, the respective sub tanks shown in FIGS. 2 and 3 are simplified in shape.

The communication tube 121L is a circular tube formed of a material, such as an elastomer, which can be elastically deformed in accordance with the extension and contraction of the sub tank 121. The communication tube 121L is bent in a state in which an upper end portion (at which the opening 121N is formed) of the communication tube 121L directly or indirectly contacts the top plate portion 121B even when a vertical dimension of the sub tank 121 (the bellows portion 121A) is maximized as a result of the extension of the sub tank 121. In other words, the communication tube 121L constantly contacts, at the other of the opposite ends thereof, the top plate portion 121B irrespective of a degree of the extension and contraction of the sub tank 121. Thus, the top plate portion 121B and the bottom plate portion 121D are forced by an elastic restoration force generated by the communication tube 121L, so as to be displaced away from each other.

Thus, the communication tube 121L is bent or deformed more strongly, in accordance with the contraction of the sub tank 121, by the pressing lever 122 pressing the top plate portion 121B. Consequently, the opening 121N is displaced downwardly in accordance with the contraction of the sub tank 121.

In contrast, when the pressing lever 122 is released, that is, a pressing force generated by the pressing lever 122 is removed, the opening 121N is upwardly displaced by a restoration force of the sub tank 121 and a restoration force of the communication tube 121L in accordance with the extension of the sub tank 121. That is, in this ink-jet printer, the opening 121N is constantly positioned at the upper end portion of the inside space of the sub tank 121 irrespective of the degree of the extension and contraction of the sub tank 121.

The sub tank 121 includes a guide which guides the communication tube 121L. As shown in FIGS. 3A and 3B, the guide is constituted by two deformation guiding ribs 121P provided on a lower face of the top plate portion 121B and each functioning as a deformation guiding member which guides the communication tube 121L such that the opening 121N moves, in accordance with the contraction of the sub tank 121, toward the central part of the top plate portion 121B as seen from an upper side of the top plate portion 121B.

As shown in FIG. 3A, the deformation guiding ribs 121P are a pair of wall-like members each extending toward the central part of the top plate portion 121B from a part of the top plate portion 121B which is located at a position just above a position at which the communication tube 121L and the second ink flow hole 121J are connected to each other. As shown in FIG. 3B, the other of the opposite ends (i.e., the upper end portion of the communication tube 121L) and part of the communication tube 121L is slidably received in a groove portion 121Q which is defined by the pair of the deformation guiding ribs 121P and the top plate portion 121B so as to have a generally rectangular three-sided shape. That is, the deformation guiding ribs 121P are configured to guide the communication tube 121L in a state in which the deformation guiding ribs 121P engage opposite sides of the other of the opposite ends of the communication tube 121L, which opposite sides are radially opposed to each other in the direction perpendicular to the vertical direction. As a result, the deformation guiding ribs 121P guide the communication tube 121L such that the opening 121N is moved in one direction as seen from the upper side of the sub tank 121.

Here, the central part of the top plate portion 121B is generally located at a position of the top plate portion 121B at which moments acting on the top plate portion 121B are generally in balance. The moments acting on the top plate portion 121B includes a moment produced by a force of the bellows portion 121A which acts on the top plate portion 121B, a moment produced by a pressure in the sub tank 121 which acts on the top plate portion 121B, and the like.

It is noted that, in this ink-jet printer, since the bellows portion 121A can be considered to apply a force to the top plate portion 121B approximately evenly, and an internal pressure evenly applies to an entirety of the top plate portion 121B according to Pascal's law, the central part of the top plate portion 121B coincides with a centroid of the top plate portion. That is, the central part coincides with a position at which area moments are balanced.

4. Main Tank Unit

As shown in FIG. 4A, the main tank unit 130 is constituted by a plurality of ink cartridges 131 each functioning as a main tank and each storing the ink which is to be supplied to a corresponding one of the sub tanks 121, a cartridge casing 132 on which the ink cartridges 131 are removably mounted, and so on.

Each ink cartridge 131 has a flat rectangular parallelepiped shape with its width being smaller than its length and depth. The ink cartridges 131 are mounted on or attached to the cartridge casing 132 in a state in which the ink cartridges 131 are arranged in a horizontal direction such that a width direction of each ink cartridge 131 substantially coincides with the horizontal direction.

5. Ink Supply Mechanisms of Station Supply Type 5-1. General Structure of Ink Supply Mechanisms of Station Supply Type As shown in FIG. 4A, ink supply mechanisms 140 of a station supply type respectively include sub-tank-side joint valves 150, main-tank-side joint valves 160, push rods 170 respectively for pushing the other ends 122B of the respective pressing levers 122, slide cams 180 for actuating the respective main-tank-side joint valves 160 and the respective push rods 170, and so on.

It is noted that the sub-tank-side joint valves 150, the main-tank-side joint valves 160, the push rods 170, the slide cams 180, and so on are provided for the respective sub tanks 121, and the ink supply mechanisms 140 including these components have the same structure. Thus, the following description will be given, taking one of the ink supply mechanisms 140 as an example.

The sub-tank-side joint valve 150 is fixed to the main body of the recording head unit 100 and communicates with the sub tank 121, As shown in FIG. 4B, a valve cap 153 in which a valve opening 152 (in FIG. 5B) is formed is fluid-tightly attached to or fitted on one end portion of a generally cylindrical valve housing 151 which is nearer to the main-tank-side joint valve 160. The valve opening 152 is closed by a displaceable valve member 154 which is disposed in the valve housing 151.

It is noted that the valve cap 153 of this ink-jet printer is formed of an elastic material such as an elastomer. Further, on one end portion of the valve cap 153 which is nearer to the main-tank-side joint valve 160, there is provided a ring-shaped projecting portion 153A which projects toward the main-tank-side joint valve 160 so as to surround the valve opening 152.

A coil spring 155 is an elastic means that presses, in a direction in which the valve opening 152 is closed, one of opposite sides of the valve member 154 which is farther from the main-tank-side joint valve 160. A preset load and a spring constant of the coil spring 155 are set such that a sum of a pressing force F1 that is applied, depending on a pressure of an inside of the valve housing 151, to the valve member 154 in a direction in which the valve member 154 is closed, and a pressing force F2 that is applied to the valve member 154 depending on the coil spring 155 is substantially equal to or slightly larger than a pressing force F3 that is applied, depending on an atmospheric pressure, to the valve member 154 in a direction in which the valve member 154 is opened.

In this ink-jet printer, the sub-tank-side joint valve 150 communicates with the upper end portion of the inside space of the sub tank 121, and the recording head 110 communicates with a lower portion of the sub tank 121.

Also, the main-tank-side joint valve 160 is connected to the sub-tank-side joint valve 150 when the ink is supplied to the sub tank 121, so that the sub tank 121 and the ink cartridge 131 communicate with each other. It is noted that, as shown in FIG. 4A, the main-tank-side joint valve 160 communicates with the ink cartridge 131 via an ink supply tube or pipe such as a tube 166 or a pipe.

As shown in FIG. 4B, a valve opening 162 is formed in one end portion of a generally cylindrical valve housing 161 which is nearer to the valve cap 153. The valve opening 162 is closed by a displaceable valve member 163 which is disposed in the valve housing 161.

A coil spring 164 is an elastic means for applying a pressing force to the valve member 163 in a direction in which the valve opening 162 is closed. A push rod 165 projects toward the sub-tank-side joint valve 150 so as to open the valve opening 152 by pressing the valve member 154 of the sub-tank-side joint valve 150. The push rod 165 is integral with the valve member 1637 so as to be displaced integrally with the valve member 163.

The slide cam 180 has a cam surface 181 which contacts respective longitudinal end portions of the push rod 170 and the main-tank-side joint valve 160 (i.e., the valve housing 161) so as to move the push rod 170 and the main-tank-side joint valve 160 in a longitudinal direction thereof (in this ink-jet printer, in the vertical direction).

In this ink-jet printer, where the push rod 170 and the main-tank-side joint valve 160 are to be moved upward, the slide cam 180 is moved toward the left side in FIG. 4A by a driving force from a sheet-discharge roller 190 which will be described below.

On the other hand, where the push rod 170 and the main-tank-side joint valve 160 are to be moved downward, a transfer of the driving force from the sheet-discharge roller 190 is interrupted, so that the slide cam 180 is moved toward the right side in FIG. 4A by an elastic force of a tension spring 182.

Also, the slide cam 180 for the sub tank 121 is integral with a base plate 183. Further, as shown in FIG. 1, a rack gear 183A is provided on a portion of the base plate 183 which is located nearer to the sheet-discharge roller 190.

A gear 190A is provided on one of longitudinal ends of the sheet-discharge roller 190. With the gear 190A, there is meshed a pinion gear 184 for transmitting a driving force from the gear 190A to the rack gear 183A (i.e., the base plate 183). The pinion gear 184 is disposed so as to be movable between a position at which the pinion gear 184 is meshed with the rack gear 183 and a position at which the pinion gear 184 is not meshed with the rack gear 183. The positions of the pinion gear 184 are shifted by an actuator (not shown) such as an electromagnetic solenoid.

It is noted that the sheet-discharge roller 190 is a discharging means for discharging, to a discharging opening (not shown), a sheet on which the image has been formed. The sheet is discharged between right and left frames 191.

5-2. General Explanation of Operation of Ink Supply Mechanism

The ink supply mechanism 140 is a station-type ink supply means that connects the sub-tank-side joint valve 150 and the main-tank-side joint valve 160 to supply the ink to the sub tank 121 when the remaining amount of the ink in the sub tank 121 is equal to or smaller than the certain amount.

It is noted that, in this ink-jet printer, when a number of the ejection of the ink by the recording head 110 (including a number of the ejection for a purging operation) reaches a certain number from a time at which the ink is last supplied to the sub tank 121, the remaining amount of the ink in the sub tank 121 is estimated to be equal to or smaller than the certain amount.

Where a controlling device (not shown) for controlling operations of the ink-jet printer judges that the remaining amount of the ink in the sub tank 121 is equal to or smaller than the certain amount, the controlling device performs an operation for moving the pinion gear 184 to the position at which the pinion gear 184 is meshed with the rack gear 183A, to rotate the sheet-discharge roller 190.

Figure 5B:
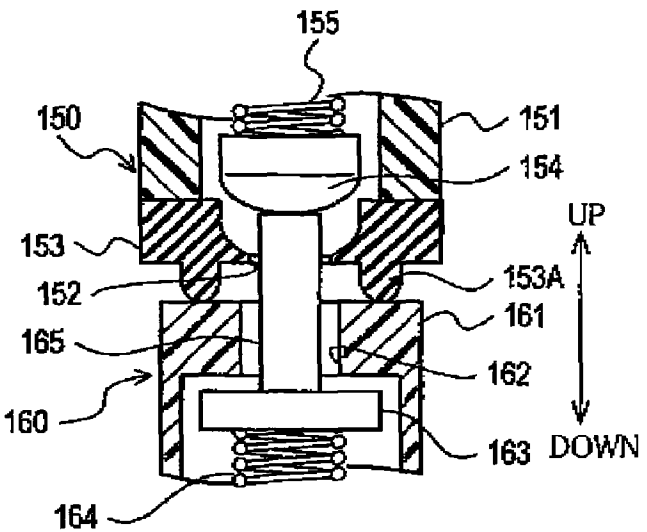
FIG. 5B is a view for explaining the operation of the joint valve upon the operation of supplying ink.
Figure 5A:
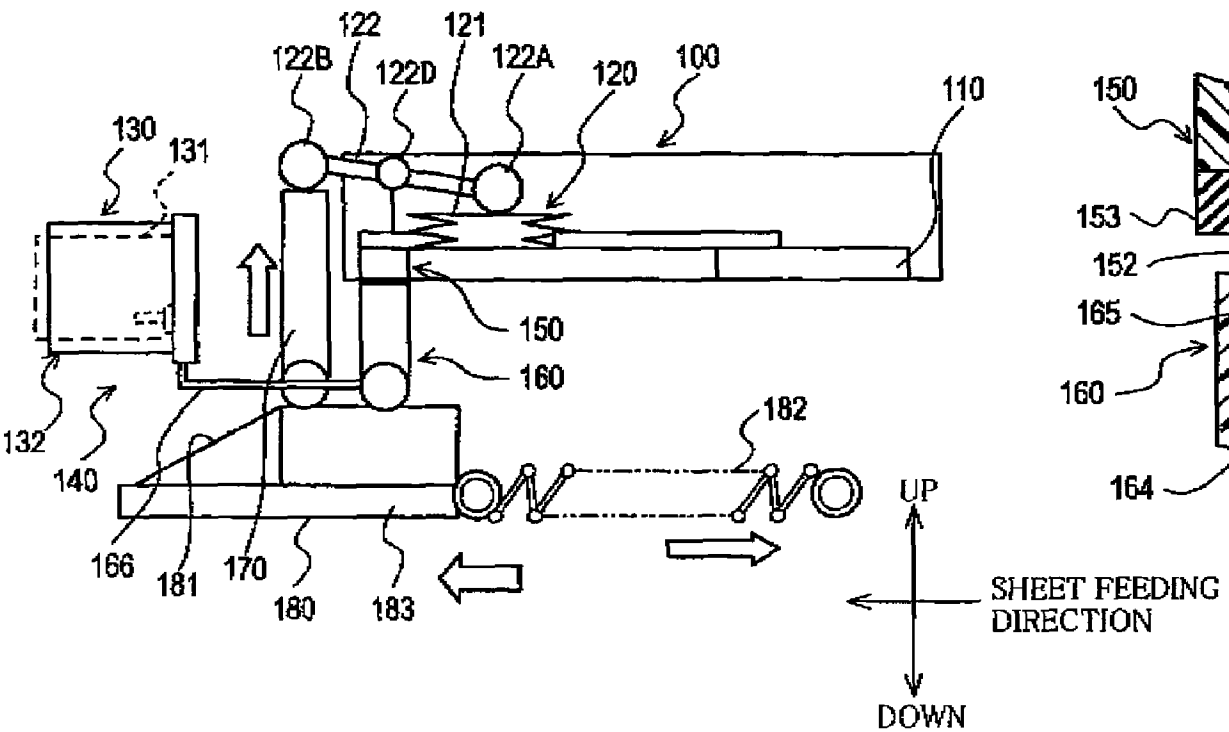
FIG. 5A is a view for explaining the operation of supplying ink.

As a result, as shown in FIG. 5A, the slide cam 180 is moved toward the left side in FIG. 4A. Thus, the push rod 170 and the main-tank-side joint valve 160 are pushed by the slide cam 180, so as to be moved upward.

As shown in FIG. 5B, when the main-tank-side joint valve 160 is moved upward, the push rod 165 of the main-tank-side joint valve 160 pushes up the valve member 154 of the sub-tank-side joint valve 150, thereby opening the valve opening 152.

Simultaneously, the valve member 163 of the main-tank-side joint valve 160 is subjected to a pushing force through the push rod 165 in a direction in which the valve opening 162 is opened. Thus, the valve member 163 is displaced downward to open the valve opening 162, so that the sub tank 121 and the ink cartridge 131 communicate with each other.

On the other hand, an end portion of the push rod 170 pushes up the other end 122B of the pressing lever 122. Thus, as shown in FIG. 5A, the one end 122A of the pressing lever 122 is moved downward, so that the sub tank 121 is contracted as if the sub tank 121 is crushed. As a result, the ink remaining in the sub tank 121 is temporarily returned to the ink cartridge 131.

It is noted that, where the sub tank 121 is contracted before the main-tank-side joint valve 160 and the sub-tank-side joint valve 150 are connected to each other, there is a high possibility that when the main-tank-side joint valve 160 and the sub-tank-side joint valve 150 are connected to each other, the ink leaks from the main-tank-side joint valve 160 and the sub-tank-side joint valve 150. Thus, in this ink-jet printer, a shape of the cam surface 181 and an operation of the slide cam 180 is set such that the sub tank 121 starts to be contracted after the sub-tank-side joint valve 150 and the main-tank-side joint valve 160 have been connected to each other.

Also, where a pressure for pressing the sub tank 121 is excessively high, there is a risk that a meniscus of the ink formed in an opening of each of the nozzles of the recording head 110 is broken. Thus, the shape of the cam surface 181 and a moving speed of the slide cam 180 is set such that the sub tank 121 is contracted at a pressure at which the meniscus is not broken (for example, equal to or lower than 4 kPa).

The controlling device considers that the contraction of the sub tank 121 is finished when a specific time has passed or when a total amount of the rotation of the sheet-discharge roller 190 reaches a specific total amount of the rotation from a time at which the sheet-discharge roller 190 is started to be rotated after the pinion gear 184 is moved to the position at which the pinion gear 184 is meshed with the rack gear 183A. Then, the controlling device performs an operation for moving the pinion gear 184 to the position at which the pinion gear 184 is not meshed with the rack gear 183A, while stopping the rotation of the sheet-discharge roller 190.

Figure 6:
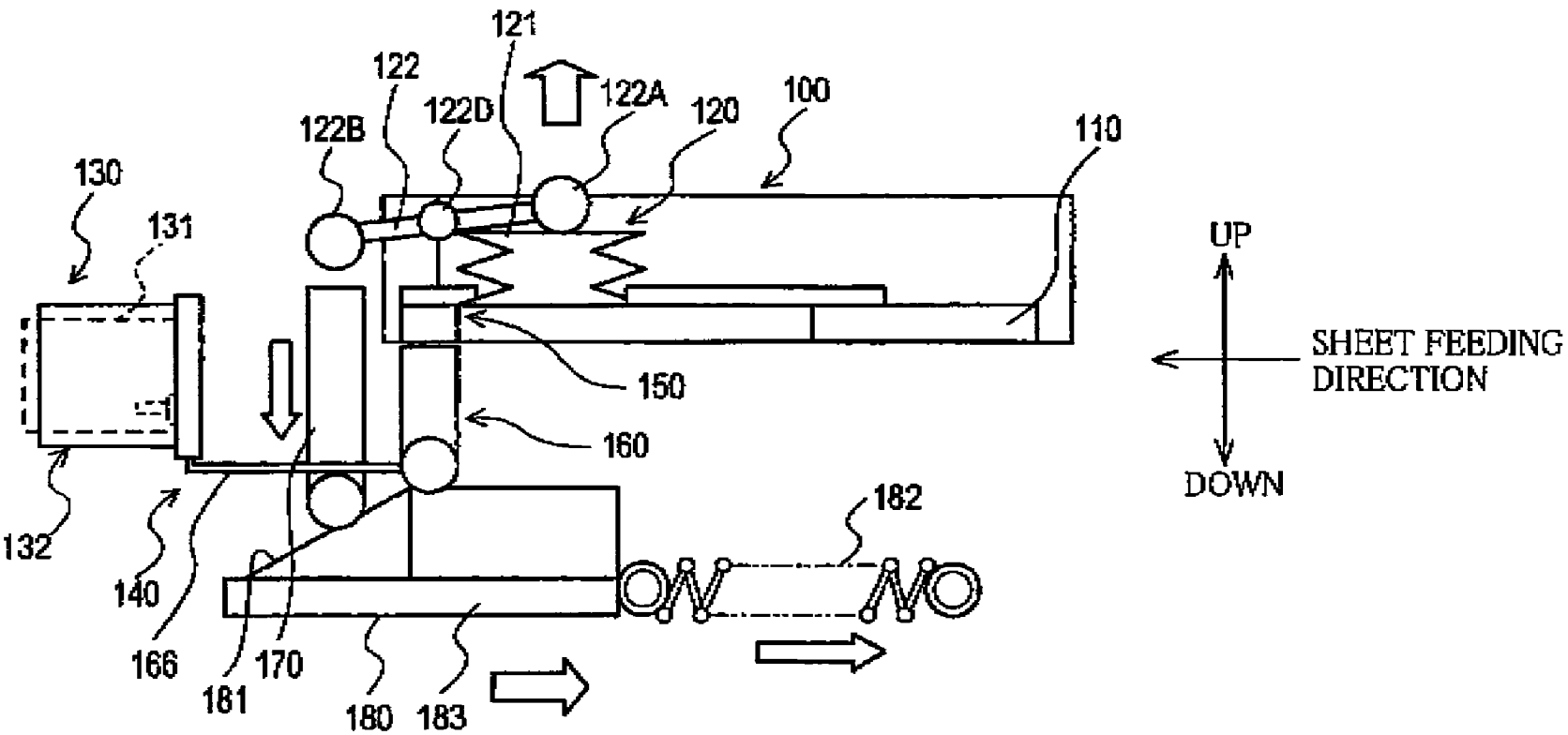
FIG. 6 is a view for explaining the operation of supplying ink.

As a result, as shown in FIG. 6, the slide cam 180 starts to be moved toward the right side in the figure, whereby the push rod 170 is moved downward, and the sub tank 121 is extended by its restoration force. Thus, the ink in the ink cartridge 131 supplied to the sub tank 121 by being absorbed by the sub tank 121.

Where the slide cam 180 is further moved toward the right side in the figure, as shown in FIG. 4A, the push rod 170 is separated from the pressing lever 122, and the sub-tank-side joint valve 150 and the main-tank-side joint valve 160 are disconnected from each other. Thus, the sub-tank-side joint valve 150 and the main-tank-side joint valve 160 are closed.

It is noted that, where the sub-tank-side joint valve 150 and the main-tank-side joint valve 160 are disconnected from each other in the state in which the push rod 170 and the pressing lever 122 contact each other, there is a high possibility that the ink leaks from the sub-tank-side joint valve 150 and the main-tank-side joint valve 160. Thus, in this ink-jet printer, the shape of the cam surface 181 and the operation of the slide cam 180 are set such that the sub-tank-side joint valve 150 and the main-tank-side joint valve 160 are disconnected from each other after the push rod 170 is separated from the pressing lever 122.

In this ink-jet printer, as shown in FIG. 4A, while the image is formed, the sub-tank-side joint valve 150 and the main-tank-side joint valve 160 are disconnected from each other, whereby the sub-tank-side joint valve 150 and the main-tank-side joint valve 160 are closed. In this state, where the ink in the sub tank 121 is consumed, the pressure in the sub tank 121 is decreased because the sub tank 121 is elastically contracted. The decreased pressure (a negative pressure) in the sub tank 121 maintains the meniscus of the ink formed in the opening of each of the nozzles of the recording head 110.

However, where a relatively large amount of the ink in the sub tank 121 is consumed and the pressure in the sub tank 121 is excessively decreased, there is a possibility that a difference between the atmospheric pressure and the pressure in the sub tank 121 is excessively large, resulting in a break of the meniscus.

However, in this ink-jet printer, the preset load and the spring constant of the coil spring 155 are set such that the sum of the pressing force F1 that is applied, depending on the pressure of the inside of the valve housing 151, to the valve member 154 in the direction in which the valve member 154 is closed, and the pressing force F2 that is applied to the valve member 154 depending on the coil spring 155 is substantially equal to or slightly larger than the pressing force F3 that is applied, depending on the atmospheric pressure, to the valve member 154 in the direction in which the valve member 154 is opened. Thus, where the pressure in the sub tank 121 is excessively decreased, the sub-tank-side joint valve 150 is opened, so that the pressure in the sub tank 121 is increased.

Where the difference between the atmospheric pressure and the pressure in the sub tank 121 is decreased to a certain magnitude of a pressure which corresponds to the pressing force of the coil spring 155, the sub-tank-side joint valve 150 is closed, so that the pressure in the sub tank 121 is maintained at a proper pressure for maintaining the meniscus.

That is, in this ink-jet printer, the sub-tank-side joint valve 150 is mechanically and automatically controlled so as to be opened and closed such that the difference between the atmospheric pressure and the pressure in the sub tank 121 is maintained at the certain magnitude of the pressure which corresponds to the pressing force of the coil spring 155.

6. Features of Ink-jet Printer as the Present Embodiment

If foreign materials different from the ink such as air and dusts enter into the recording head 110, ink ejection failure occurs. To prevent this, the ink-jet printer as the present embodiment performs a positive pressure purging operation in which the sub tank 121 is contracted periodically or when commanded by a user so as to discharge, to an outside of the recording head 110, together with the ink, the foreign materials in the recording head 110.

To reliably discharge the foreign materials in the recording head 110, a relatively high ink pressure (e.g., equal to or greater than about 50 kPa) needs to be generated. However, where the sub tank is deformed so as to be expanded in the direction intersecting the extension and contraction direction because of the increase of the pressure in the sub tank 121 which is caused by the increase of the ink pressure, the positive pressure purging operation cannot be performed sufficiently.

This problem can be solved if the sub tank 121 is formed of a material having a high rigidity or formed in a shape providing the high rigidity. However, the sub tank 121 thus formed is difficult to be deformed, so that a larger amount of force is required when the sub tank 121 is extended and contracted. Thus, it is not appropriate to form the sub tank 121 so as to have the high rigidity in order to solve the problem.

However, in this ink-jet printer, on the outer side of the bellows portion 121A, there is provided the deformation restraining ring 121E which restrains the sub tank 121 from deforming in the direction intersecting the extension and contraction direction thereof. Thus, the sub tank 121 can be restrained from deforming outwardly without being inhibited from being extended and contracted in the extension and contraction direction thereof.

Meanwhile, when the bellows portion 121A is expanded outwardly, the smaller diameter parts thereof tend to be deformed prior to the larger diameter pas thereof. Further, where the smaller diameter parts are expanded, the positive pressure purging operation cannot be effectively performed. However, in this ink-jet printer, since the deformation restraining ring 121E is fitted on one of the smaller diameter parts of the bellows portion 121A, the sub tank 121 can be effectively restrained from being deformed. Thus, the positive pressure purging operation can be effectively performed, Also, the contacting portion 121F has the taper shape as described above. That is, the dimension h of the contacting portion 121F in the direction parallel to the extension and contraction direction decreases as being nearer to the bellows portion 121A, thereby preventing that the deformation restraining ring 121E inhibits the bellows portion 121A from being contracted.

Meanwhile, there will be considered a case where the first ink flow hole 121H communicating with the recording head 110 is provided in an upper portion of the sub tank 121, and the second ink flow hole 121J communicating with the main tank unit 130 is provided in a lower portion of the sub tank 121. In this case, even where the sub tank 121 is contracted so as to discharge air in the sub tank 121 to the main tank unit 130, air accumulated in an upper portion of the inside space of the sub tank 121 is supplied to the recording head 110, and the only ink existing in a lower part of the inside space of the sub tank 121 is supplied to the main tank unit 130. As a result, the ink ejection failure easily occurs in comparison with an ink-jet printer not having a configuration like this.

It is noted that, like the positive pressure purging operation, an operation in which the sub tank 121 is contracted in order to discharge air in the sub tank 121 to the main tank unit 130 (hereinafter, the operation will be referred to as an air discharging operation) is performed periodically or when commanded by the user.

In this ink-jet printer, as described above, the second ink flow hole 121J and the upper end portion of the inside space of the sub tank 121 communicate with each other via the opening 121N which is displaced downward in accordance with the contraction of the sub tank 121. Further, the air in the sub tank 121 is always positioned in the upper portion of the inside space of the sub tank 121 irrespective of the degree of the deformation of the sub tank 121.

Thus, in this ink-jet printer, the opening 121N can be positioned, irrespective of the degree of the deformation of the sub tank 121, at a part of the inside space of the sub tank 121 in which air is accumulated. Consequently, the air in the sub tank 121 can be reliably discharged to the main tank unit 130.

Further, in this ink-jet printer, the communication tube 121L is elastically deformed in accordance with the contraction of the sub tank 121. Thus, the sub tank 121 can be restored to its original shape also using the elastic force (i.e., the restoration force) of the communication tube 121L, whereby the sub tank 121 is reliably extended. That is, the top plate portion 121B and the bottom plate portion 121D are forced by the restoration force so as to be displaced away from each other, Furthermore, this ink-jet printer includes the deformation guiding ribs 121P which guide the communication tube 121L such that the opening 121N moves toward the central part of the top plate portion 121B in accordance with the contraction of the sub tank 121. Thus, when the vertical dimension of the sub tank 121 is minimized as a result of the contraction of the sub tank 121, the communication tube 121L can be deformed such that the opening 121N is positioned at the central part, as seen from the upper side of the sub tank 121, of the top plate portion 121B. In other words, the communication tube 121L can be deformed such that the opening 121N is positioned at a central part, as seen from the upper side of the sub tank 121, of the upper end portion of the inside space of the sub tank 121.

Where the opening 121N is positioned at the central part of the top plate portion 121B when the vertical dimension of the sub tank 121 is minimized as a result of the contraction of the sub tank 121, the communication tube 121L can assist a restoration of the sub tank 121 while restraining an inclination of the sub tank 121 when the sub tank 121 is restored to its original shape. More specifically, the communication tube 121L can assist the restoration of the sub tank 121 without inclination of the top plate portion 121B.

Meanwhile, in this ink-jet printer, the first ink flow hole 121H and the second ink flow hole 121J are provided in the bottom plate portion 121D. If the first ink flow hole 121H and the second ink flow hole 121J are provided in the top plate portion 121B, it becomes difficult, when the pressing lever 122 presses the sub tank 121 (i.e., the top plate portion 121B), that the sub tank 121 is deformed evenly in the vertical direction because the sub tank 121 is inclined due to, e.g., a presence of flexible ink tubes connected to the first ink flow hole 121H and the second ink flow hole 121J.

Where the sub tank 121 is not contracted evenly in the vertical direction, an actual degree of the contraction of the sub tank 121 relative to an amount of the operation of the pressing lever 122 is decreased. Thus, an efficiency of the pressing of the pressing lever 122 is lowered, thereby lowering efficiencies of respective operations such as the positive pressure purging operation, the air discharging operation, and an operation for returning the ink to the main tank unit 130.

However, in this ink-jet printer, the first ink flow hole 121H and the second ink flow hole 121J are provided in the bottom plate portion 121D on which the pressing force of the pressing lever 122 does not act directly. Thus, the sub tank 121 can be contracted evenly in the vertical direction, thereby preventing the lowering of the efficiencies of the respective operations such as the positive pressure purging operation and the operation for returning the ink to the main tank unit 130.

7. Other Embodiments

In the above-described embodiment, as shown in FIG. 3A, the first ink flow hole 121H and the second ink flow hole 121J are provided in opposite side parts of the bottom plate portion 121D, but the ink-jet printer according to the present invention is not limited to this arrangement.

In the above-described embodiment, the bellows portion 121A can be extended and contracted in the vertical direction, but the ink-jet printer according to the present invention is not limited to this configuration. Further, in the above-described embodiment, the communication tube 121L can be elastically deformed, but the ink-jet printer according to the present invention is not limited to this configuration. That is, for example, the opening 121N may be connected to the top plate portion 121B, e.g., by modifying the communication tube 121L to have a telescopic configuration so as to be extended and contracted in its axial direction, by pivotably attaching the communication tube 121L to the bottom plate portion 121D so as to pivot in the vertical direction in accordance with the vertical displacement of the top plate portion 1211B, or by modifying the communication tube 121L to be formed of a flexible material having little elasticity.

In the above-described embodiment, the guide for guiding the communication tube 121L during its deformation such that the opening 121N moves toward the central part includes the deformation guiding ribs 121P, but the ink-jet printer according to the present invention is not limited to this configuration. That is, for example, the communication tube 121L may be connected to the second ink flow hole 121J in a state in which the communication tube 121L is inclined relative to the bottom plate portion 121D, or the top plate portion 121B may be provided with an inclined surface for guiding, during an initial deformation of the communication tube 121L, a direction in which the communication tube 121L is deformed.

In the above-described embodiment, the deformation restraining ring 121E is provided at the position at which the bellows portion 121A is divided into two equal parts in the vertical direction, but the ink-jet printer according to the present invention is not limited to this configuration. That is, for example, (n−1) pieces of deformation restraining rings 121E may be fitted on the bellows portion 121A such that the bellows portion 121A is divided into a total number of n equal parts in the vertical direction. As another modification, the deformation restraining ring 121E or the (n−1) pieces of deformation restraining rings 121E may be fitted on the bellows portion such that the bellows portion 121A is divided into unequal parts in the vertical direction, or the deformation restraining ring 121E may not be provided, for example.

In the above-described embodiment, the sub tank 121 has the substantially rectangular shape in its cross section, but the ink-jet printer according to the present invention is not limited to the this configuration. That is, for example, the sub tank 121 may have a round shape in its cross section.

In the above-described embodiment, the deformation restraining ring 121E is fitted on the bellows portion 121A such that the contacting portion 121F is fitted on the one of the smaller diameter parts, but the ink-jet printer according to the present invention is not limited to this configuration. That is, for example, the deformation restraining ring 121E may be fitted on the bellows portion 121A so as to cover a top part of one of the larger diameter parts.

In the above-described embodiment, the contacting portion 121F has the taper shape, but the ink-jet printer according to the present invention is not limited to this configuration. That is, for example, the, contacting portion 121F may have a spherical shape. Also, in the above-described embodiment, the deformation restraining ring 121E has the generally rectangular shape having the rounded corners (i.e., a generally O-shape), but the ink-jet printer according to the present invention is not limited to this configuration. That is, for example, the deformation restraining ring 121E may have a U-shape or a C-shape.

In the above-described embodiment, the present invention is applied to the ink-jet printer of the station supply type, but the application of the present invention is not limited to the ink-jet printer of the station supply type. Further, the present invention is not limited to the details of the illustrated embodiments, but may be embodied with various changes and modifications, which may occur to those skilled in the art, without departing from the spirit and scope of the present invention.

What is claimed is:

1. An ink-jet printer, comprising:

a recording head which ejects ink onto a recording medium;

a main tank which stores the ink to be supplied to the recording head;

a sub tank configured to be extended and contracted in a vertical direction and including first and second ink flow holes provided in a lower portion of the sub tank, such that the first ink flow hole communicates with the recording head while the second ink flow hole communicates with the main tank; and a communication tube which is connected, at one of opposite ends thereof, to the second ink flow hole and which has, at the other of opposite ends thereof, an opening positioned in an inside space of the sub tank, whereby the second ink flow hole and the inside space of the sub tank communicate with each other via the communication tube, wherein the communication tube is configured such that the opening of the communication tube is displaced downwardly in accordance with the contraction of the sub tank.

2. The ink-jet printer according to claim 1, wherein an entirety of the communication tube is in the sub tank.

3. The ink-jet printer according to claim 1, wherein in accordance with the extension and contraction of the sub tank, the communication tube is deformed such that the opening is displaced upwardly and downwardly.

4. The ink-jet printer according to claim 3, wherein the opening is positioned at an upper end portion of the inside space of the sub tank, irrespective of a degree of the extension and contraction of the sub tank.

5. The ink-jet printer according to claim 3, wherein the communication tube is elastically deformed in accordance with the extension and contraction of the sub tank.

6. The ink-jet printer according to claim 1, wherein the sub tank has an upper end wall, a lower end wall, and a peripheral wall which is provided between the upper end wall and the lower end wall and which is configured to be extended and contracted in the vertical direction, wherein the second ink flow hole is provided in the lower end wall, wherein the communication tube extends from the lower end wall toward the upper end wall, and wherein the communication tube constantly contacts, at the other end thereof, the upper end wall of the sub tank, irrespective of a degree of the extension and contraction of the sub tank.

7. The ink-jet printer according to claim 6, wherein the communication tube is elastically bent, irrespective of the degree of the extension and contraction of the sub tank.

8. The ink-jet printer according to claim 7, wherein the upper and lower end walls are forced by an elastic restoration force generated by the communication tube, so as to be displaced away from each other.

9. The ink-jet printer according to claim 1, wherein when a vertical dimension of the sub tank is minimized as a result of the contraction of the sub tank, the opening of the communication tube is positioned at a central part, as seen from an upper side of the sub tank, of an upper end portion of the inside space of the sub tank.

10. The ink-jet printer according to claim 9, further including a guide which guides the communication tube such that the opening moves toward the central part in accordance with the contraction of the sub tank.

11. The ink-jet printer according to claim 10, wherein the guide is configured to guide the communication tube in a state in which the guide engages opposite sides of the other of the opposite ends of the communication tube, the opposite sides being radially opposed to each other in a direction perpendicular to the vertical direction.

12. The ink-jet printer according to claim 10, wherein the guide is configured to guide the communication tube such that the opening is moved in one direction as seen from an upper side of the sub tank.

13. The ink-jet printer according to claim 10, wherein the sub tank has an upper end wall, a lower end wall, and a peripheral wall which is provided between the upper end wall and the lower end wall and which is configured to be extended and contracted in the vertical direction, wherein the second ink flow hole is provided in the lower end wall, wherein the communication tube extends from the lower end wall toward the upper end wall, wherein in a state in which the sub tank is extended, the opposite ends of the communication tube are positioned at respective positions each of which is located outside the central part of the upper end wall as seen from an upper side of the sub tank, and wherein the communication tube is bent more strongly in accordance with the contraction of the sub tank

14. The ink-jet printer according to claim 13, wherein the guide is provided on a lower face of the upper end wall of the sub tank such that a groove portion in which the communication tube is received is formed.

* * * * *